US010130894B2

(12) United States Patent
Peiler

(10) Patent No.: US 10,130,894 B2
(45) Date of Patent: Nov. 20, 2018

(54) PLANARLY CONNECTABLE TOY BRICKS COMPRISING AN UNILATERALLY OPEN, BOX-LIKE HOLLOW BODY AND PLUG-IN STUDS AT THE BOTTOM OUTER SIDE AS WELL AS A BOTTOM DOME ON THE BOTTOM INNER SIDE

(71) Applicant: Joachim Peiler, Gremsdorf (DE)

(72) Inventor: Joachim Peiler, Gremsdorf (DE)

( * ) Notice: Subject to any disclaimer, the term of this patent is extended or adjusted under 35 U.S.C. 154(b) by 0 days.

(21) Appl. No.: 15/567,124

(22) PCT Filed: Apr. 13, 2016

(86) PCT No.: PCT/EP2016/025036

§ 371 (c)(1),
(2) Date: Oct. 17, 2017

(87) PCT Pub. No.: WO2016/169660

PCT Pub. Date: Oct. 27, 2016

(65) Prior Publication Data

US 2018/0099233 A1 Apr. 12, 2018

(30) Foreign Application Priority Data

Apr. 21, 2015 (DE) ..... 20 2015 002 996 U

(51) Int. Cl.
*A63H 33/04* (2006.01)
*A63H 33/08* (2006.01)

(52) U.S. Cl.
CPC ..... *A63H 33/086* (2013.01); *A63H 33/04* (2013.01)

(58) Field of Classification Search
CPC ..... A63H 33/04; A63H 33/044; A63H 33/06; A63H 33/062; A63H 33/065; A63H 33/08; A63H 33/086; A63H 33/088
See application file for complete search history.

(56) References Cited

U.S. PATENT DOCUMENTS 879,455 A 2/1908 Frost
3,162,973 A * 12/1964 Christiansen ..... A63H 33/086 446/128

(Continued)

FOREIGN PATENT DOCUMENTS

DE 1076007 B 2/1960
DE 1837030 U 8/1961

(Continued)

*Primary Examiner* — Gene Kim
*Assistant Examiner* — Alyssa Hylinski
(74) *Attorney, Agent, or Firm* — Rankin, Hill & Clark LLP

(57) ABSTRACT

The invention relates to planarly connectable toy bricks comprising an unilaterally open, box-like hollow body and plug-in pins at the bottom outer side and bottom domes on the bottom inner side. In order to achieve increased frictional force both plug-in pins on the upper side of the toy brick and bottom domes on the bottom side of the toy brick are designed as an n-rectangular straight prism having parallel and equally long side edges. Ribs are designed as double-webbed retaining protrusions, the plug-in pins have through-holes of different shapes at the bottom as well as stabilizing webs which extend between the retaining protrusions and parallel thereto. A click system is provided, which ensures that user has apart from the visual and haptic perception an acoustic perception of the completion of the clamping of two toy bricks.

9 Claims, 8 Drawing Sheets

(56) References Cited

U.S. PATENT DOCUMENTS

Figure 1A:
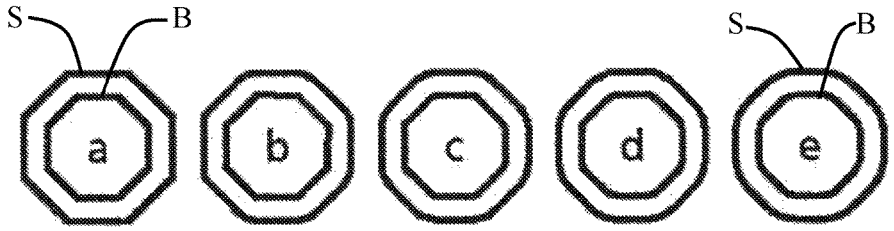

| | | | | | |
|---|---|---|---|---|---|
| 3,487,579 | A * | 1/1970 | Brettingen | A63H 33/086 | 446/128 |
| 4,582,495 | A * | 4/1986 | Orgass | A63H 33/088 | 446/102 |
| 5,683,283 | A * | 11/1997 | Glynn | A63H 33/086 | 446/128 |
| 6,102,766 | A * | 8/2000 | Leadbetter | A63H 33/086 | 446/124 |
| 6,645,033 | B1 * | 11/2003 | Thomsen | A63H 33/086 | 446/120 |
| 8,002,241 | B1 * | 8/2011 | Shaw | B66F 7/243 | 248/346.5 |
| 8,771,032 | B2 * | 7/2014 | Chang | A63H 33/086 | 446/124 |
| D717,379 | S * | 11/2014 | Deutsch | D21/499 | |
| 2002/0106963 | A1 * | 8/2002 | Chiu | A63H 33/086 | 446/125 |
| 2010/0203796 | A1 * | 8/2010 | Beg | A63H 33/042 | 446/120 |
| 2010/0210173 | A1 * | 8/2010 | Maggiore | A63H 33/062 | 446/125 |
| 2014/0256211 | A1 | 9/2014 | Cheng | | |

FOREIGN PATENT DOCUMENTS

| | | | | |
|---|---|---|---|---|
| DE | 1678326 | A1 | 2/1972 | |
| DE | 2242046 | A1 | 2/1974 | |
| DE | 3333097 | C1 | 3/1985 | |
| DE | 19506701 | A1 | 8/1996 | |
| DE | 60012300 | T2 | 11/2004 | |
| DE | 202005017849 | U1 | 1/2006 | |
| DE | 202005002378 | U1 | 4/2006 | |
| DE | 202012001201 | U1 | 5/2012 | |
| KR | 101459693 | B1 | 11/2014 | |
| WO | 2011083173 | A1 | 7/2011 | |
| WO | WO 2014009345 | A1 * | 1/2014 | A63H 33/086 |

* cited by examiner

PLANARLY CONNECTABLE TOY BRICKS COMPRISING AN UNILATERALLY OPEN, BOX-LIKE HOLLOW BODY AND PLUG-IN STUDS AT THE BOTTOM OUTER SIDE AS WELL AS A BOTTOM DOME ON THE BOTTOM INNER SIDE

BACKGROUND OF THE INVENTION

1. Field of Invention

The invention relates to planarly connectable toy bricks.

2. Brief Description of the Related Art

Toy bricks of a conventional design are constructed in a petrochemical way by means of circular closed primary pins (push buttons) upperside and cylindrical secondary pins and clamping elements (bottom dome) arranged offset as counterpoles in the hollow body. Standard elements are produced which can be assembled in a simple manner for the production of any constructions of different shapes and appearance and can be easily disassembled for further use. The toy bricks are thus provided on the cover with coupling members in the form of cylindrical primary pins (push buttons) juxtaposed in a defined grid. The pins are connected to the secondary pin (bottom dome) arranged on the bottom plate, the secondary pins clampingly fitted between the primary pins of an adjacent toy brick.

If two toy bricks are assembled in this way, the primary pins (push buttons) reach the recesses released by the secondary pins (bottom dome). This only achieves a single point (principle: circle-tangent) merger, which fixes both toy bricks. In this case, the less the number of primary pins enter the recesses of the secondary pins of the other toy brick, the less the fixation is.

Such a point-by-point combination in the case of a toy building element of the last-identified type designed as a box-like hollow body with outer primary pins is known as the first alternative from DE 1 076 007 B. The toy building element known therefrom is provided on one side of the wall with coupling elements in the form of pairs of preferably cylindrical primary pins, wherein the secondary pin (bottom dome) arranged on the bottom plate projecting clampingly fitted between the primary pins of an adjacent structural element, and wherein, in the case of a first alternatively the secondary pins are designed in the form of cylindrical tubes. The cylindrical secondary pins are, in this case, arranged in such a way that the circumference of a secondary pin touches the circumferential circumferences of four primary pins, i.e. basic circle of each secondary pin always touches the basic circles of four primary pins. In order to improve the clamping connection with an adjacent structural element or several, alternatively the secondary pins have a cross-shape and have on their outer surfaces a counterprofiling corresponding to the circumference of the primary pin. Finally, it is alternatively provided that the secondary pins have prismatic cross-sections with concave surfaces which come into contact with the outer surfaces of the primary pins of an adjacent structural element. The secondary pins are designed as hollow bodies and—in order to increase the clamping action of the secondary pins—are additionally provided with slots. Regardless of whether the toy building element is rectangular or square, the basic circuit of each secondary pin always touches the basic circles of the four primary pins. Furthermore, the inner walls of the hollow body are additionally provided with clamping studs/push buttons, in particular ribs or convex projections, for engaging the primary pins of an adjacent structural element. The secondary pin (s) end flushes with the bottom wall of the hollow structural element and its inner diameter is substantially equal to the outer diameter of the primary pins. A modified embodiment relates to a toy building element having a square bottom surface and a through opening in the middle of the bottom surface, such that the tubular secondary pins enclose a hole in the bottom of the hollow body with the same diameter as the inside diameter of the tube. This makes a simple coupling of the toy building element with tubular or rod-shaped elements which extend into a coupling pin whose outer diameter corresponds to the diameter of the hole. The tubular secondary pins can also be continued on the other side of the bottom of the hollow body and on this side projected in one of the height of the primary pins corresponding distance. Also, the secondary pins may be solid or conical in shape. The variants mentioned in DE 1 076 007 B are not disclosed, according to which, in place of the cylindrical primary pins, pins of any other shape are used which fit into the interspaces between the inner clamping members and into the interspaces between them and the inner walls of the hollow body.

In a further development, DE 1 837 030 U discloses a toy building element, preferably in the form of a box-like hollow body open on one side, the one surface of which has circular or polygonal coupling pins (primary pins) on the outer side in the cross-section. Furthermore the toy building element have instead the inner tubular pins (secondary pins) inner ribs, wherein the ribs form an angle of 45° with the side walls and end walls of the toy building element, and wherein the distance between two parallel ribs being equal to the diameter of the coupling pins or the one of the inner guide pins, polygonal cross-section of the same inscribed circle. In a preferred embodiment, the ribs are arranged to cross each other at a right angle. As a result, the toy building element is divided into several cells with the pins of one adjacent structural element, in such a way that the coupling pins introduced into the cavity (circular or polygonal pins) between the cell walls or between them are clamped to the side or end walls of the component. Some of these cells, namely the cells located towards the center of the cavity of the element, have a square cross-section, while the others have a pentagonal or triangular cross-sectional shape. The cells, which are five-fold in cross-section, also serve to receive coupling pins of an adjacent structural element, whereas the triangular cells alone can serve the bracing of the structural element. The number of cells depends, moreover, on the shape and dimensions of the toy component. The main type is a rectangular structural element in the shape of a box-like hollow body open on one side with eight outer coupling pins (circular or polygonal pins), and has, for example, three square-cross-section cells, eight five-cross-section cells, and eight triangular-cross-section cells, while another main type with square cross bottom have a middle quadratic cross-section cell, four five-cross-section cells and four cells with a triangular cross-section.

In practice, toy components according to DE 1 076 007 B have shown that, in the case of newly manufactured components, a comparatively great coupling force with adjacent structural elements is present which, after prolonged use of the components, can be reduced to a coupling force or residual coupling force, which is only about 25% of the original coupling force. The presence of a comparatively large coupling force in newly manufactured components makes this at first the connecting and in particular also the release of two components which are in engagement are comparatively difficult and frequently the force of a child is not sufficient when using newly manufactured to release easily the components for constructing another building toy or the like. In practice, it has also been shown that, partly because of the inevitable abrasion on the coupling sites when the building blocks are used, whereby the coupling force drops gradually to about 50% of the initial pull-off force, and partly because of the cold flow of the coupled stones, which remain unaffected for a long time (as is the case with built models), a decrease in the coupling force occurs, leaving a residual coupling force of only about 25% of the initial pull-off force, and the built-up models are undesirably broken during construction and play. In order to ensure that, in the case of newly manufactured components, the coupling force against these components is reduced from the beginning, and furthermore, in the course of time, after frequent use of the building blocks for such building toys, coupling force does not fall below a certain and desired degree (residual coupling force), so that even after repeated use of the components for building toys, a sufficient coupling force which moves within certain tolerance limits is maintained, the toy building block according to DE 2 242 046 A discloses, with a reduction in the wall thickness of a building block (e.g. for example according to the German patent 1 076 007 B), projections (in particular in the form of ribs, projections, etc.) are additionally provided on the inner walls of the hollow structural part in the region in which the primary coupling elements of an adjacent structural element to engage the inner wall. Furthermore, the secondary coupling pins have slots which either extends in the longitudinal axis of the module or else in their transverse axis, and the outer diameter of a middle secondary coupling element in the form of a secondary hollow pin of a component is increased by a small amount against the wall thickness of known secondary hollow pins. Furthermore, the distance between the central axes of two adjacent secondary coupling pins is increased by a small amount, and finally, middle hollow pins of adjacent pins are reduced by a small amount. The coupling force of newly manufactured components according to the invention is decreased compared to the above-mentioned known components and at the same time the residual coupling force is increased by approximately 100% compared to the residual coupling force of the above-mentioned known components (residual coupling force, up to now, 25% residual coupling force and now amounts to 50%). As a result of the reduction in the wall thickness of the hollow structural element in conjunction with the ribs, projections or the like, it is now possible to manufacture such toy building blocks from a cheaper plastic material. Furthermore, the comparatively very narrow tolerance limits for a building block, for example, according to the German patent 1 076 007 B, could be significantly extended resulting in a simpler manufacture of such structural elements for construction toys. Finally, the buildability is maintained with components already produced and in use, and the catching-up requirement can be satisfied.

In order to preserve the expandability of large building blocks and their usability with the basic building blocks, it is known from DE 16 78 326 C3 that the large building blocks are designed as a box open on one side and which have between primary coupling pins arranged at the arranged on the outer side of the base and secondary coupling pins arranged at the bottom side an axial distance which corresponds to the double of the basic module. Furthermore, the primary coupling pins are tubular and the inner diameter of the primary coupling pins corresponds to the outer diameter of the secondary coupling pins of the base building blocks. On the inside of the large building side walls are recesses to accommodate the primary coupling pins of the basic components. Finally, the secondary coupling pins of the large building blocks either have recesses for primary coupling pins of basic blocks or a smaller length than the large building side walls.

In order to improve the clamping connection of building toy components with an outer shape such as rectangular boxes, and with, for example, four-cylindrical coupling necks (primary pins) arranged on their upper surface, and to allow the clipping connection by means of pins in the vertically extending, it is known from DE 600 12 300 T2 that vertically extending tubular openings/passages of the component have an internal flange at a distance from the ends of the openings. Furthermore, tubular connecting sleeves are provided, which have a projecting annular flange or collar at their middle part, and on the two sides of the flange have two oppositely arranged tubular pins. Each of the two pins of the connecting bushes comprises, at its free end, two axially extending slots extending from the ends of the pin and spaced inwardly from these ends. In addition, two ribs or beads are provided at the end of each pin, which extended in the shape of a ring and substantially between the slots. The slots allow the ends of the pins to bend in the radial direction, and the beads extended the end of the pin a thickness slightly higher to the diameter of the through openings. When the end of a pin is inserted into a passage opening, the beads—which have a rounded profile—first touch a recess when they reach the transition to the tubular part of the opening. This makes the two parts of the pin are pressed and the beads are slid over the inside of the tubular flange portion of the opening. The pin flange will thereby be caused to engage the recess and prevent the complete transport of the pin through the opening, and the beads will be caused to engage the recess at the opposite end of the opening. As a result, the bending ends of the pins expand again with a snap effect and the beads counteract the extraction of the pin. Thus, it is also possible to construct the components in a vertical direction by using the same pins—as in the case of a adjacent connection. Therefore, the components can be connected both horizontally and vertically by means of the same type of connecting bushes with pins, and the connection in the vertical direction can be combined with the known connection by means of stubs/pins in pure frictional engagement with the walls of a cavity. This results in a particularly stable connection with increased resistance to separation since the force for holding together the elements by frictional engagement is supplemented by the force which is used by the connecting bushing to hold the components together.

To enhance the learning effect while playing, without to reduce the functionality of a plug-in module and at the same time to reduce the manufacturing effort to a minimum, a plug-in module consisting of a base element and a connecting element is known from DE 20 2005 002 378 U1. The base element has side walls of uniform height and on upper side a cover section integral with the side walls. Furthermore, the base element has in its lower region an opening with a symmetrical geometric shape and is essentially hollow in its interior. The connecting element, which is connected to the cover section, projects upwards from this, whereby each connecting element is designed as a three-dimensional number, three-dimensional letter or as another three-dimensional motif with an asymmetrical outline, and the contour of the form of the opening in the basic element is adapted such that, that the contour by vertical projection is arranged within the contour of the opening and touches it at a plurality of points. This embodiment ensures that with different motifs of the connecting element a sufficiently stable plug-in connection with the element of another plug-in module is reached, whereby the production is simplified by the opening of equal-sized basic elements regardless of the motif of the connecting element to be inserted. The exact geometric conformity of the outline of the connecting element and the inner boundary of the side walls of the base element is essential for a secure plug-in connection between two plug-in modules. In order to further strengthen the clamping safety, ribs can be arranged on the inside of the side walls of the base element, which ribs extend vertically and represent the contact points with the inserted connecting element. The connection of the basic element and the connecting element of the second-part plug-in module is, for example, made by gluing or inserting/clipping of the connecting element on the cover section. This is an appropriate recess in the cover section, into which the connecting element can be partially inserted. The connection element is fixed in the recess by the exact constructural conformity of the dimension such that a clamping force is generated which increases the clamping force between the connecting element and the side walls of another plug-in module in the case of the plugging-together of the two plug-in modules. Likewise, it is possible to provide a snap-fit device in the recess. Furthermore, it is possible to manufacture the plug-in modules in two-component injection molding in one piece from plastic, in particular polypropylene or rubber.

In order to provide a structural element consisting of a body, which is elongated in plan in the form of a box open on one side, which on the side opposite the open side in the longitudinal direction there are small conical tapers with an approximately cylindrical contour and coaxially distributed recesses distributed uniformly over the lateral surface and in the interior of which clamping elements are integrally connected thereto and extending parallel to the indentations, which are designed in such a way that two identically designed components connected to one another by means of a pin can be rotated relative to one another without the components having to be separated from one another, in the prior art DE 33 33 097 C1 it is known that the clamping elements are webs which are integrally connected both to the cover plate and to the associated side wall and transversely to their plane are slightly resiliently deformable and that the recesses are grooves. In the connection state with another component of the same design, the inner web edges of opposing pairs of webs engage clampingly into the grooves of a pin of the other component in their lower region. The cross section of the grooves on the one hand and the formation of the webs on the other hand are adapted with one another in such a way that, when the two components of the same constructional elements are connected to one another by means of a pin, the webs spring out resiliently and engage in the respectively adjacent grooves of the pin. In order to avoid too much elasticity of the side walls, between adjacent pair of webs a partition wall is parallel to each other which is integrally connected to the cover plate and the side walls. When assembling and the selection of the angle position occurring during the assembly, this is pointed out during the adjustment by a "clack" type sound when the web edges engage the grooves. When jamming, not only the respective web pairs with the opposing side walls spring out slightly towards the outside, but the edges of the webs are also pushed apart, so that the assembly and loosening of the structural elements is considerably facilitated.

In order to create a modular play system which also enables the realization of large-area structural elements with smooth, continuous surfaces to achieve a model-like appearance and a fixed snap-in connection with permanently stable latching and holding properties, DE 195 06 701 A1 discloses a connecting element which has first snap-in elements on their one side, for the easy releasable connection with corresponding first detent recesses on the structural elements and has second detent recesses on their other side, for the difficulty detachable connection with corresponding second detent recesses of the structural elements. This design makes the manufacture of the actual components separate from the manufacture of the connecting elements, and only when the child takes such a play system in use does it brings connecting elements to the structural elements via a difficult removable snap-in connection. In detail, it is provided that the connecting elements can be inserted with their second snap-in means into the second snap-in recesses of the structural elements such that, respectively, of the second snap-in recess only the first snap-in elements protrude outwards. This means that the connecting elements are inserted positively in the respective structural element and only the first snap-in element protrudes outwards. These first snap-in elements are advantageously pin-shaped in particular in the form of a cross-slotted pin. In this case, it is also advantageously provided that the first snap-in elements are arranged on a rectangular basic body and the slots extend in the direction of the diagonals of the rectangular basic body. In the region of the outer ends of the pin-shaped snap-in elements, snap-in projections are formed which extend approximately in the direction vertical to the axial direction of the pin-shaped snap-in elements. These snap-in projections may extend only over a portion of each sector of the cruciformly slotted pin-shaped snap-in elements, in particular in such a way that each of four snap-in projections extends on either side of the center of a rectangle side. The second snap-in devices are connected to the base body of the connecting elements by snap-in projections. In this case, each basic body can have a rectangular, non-square basic shape, and the snap-in projections can each be arranged on the longitudinal sides of the base body. By means of this embodiment, it is achieved that the snap-in connection is not released by rotational movements, and accordingly is difficult to detach. A detachment of this snap-in connection is effected exclusively by pulling in the direction perpendicular to the basic body of the snap-in connection element. In contrast, the above-described easily detachable snap-in connection with the aid of the slotted pin allows twisting of two components connected in such a way to each other so that, without the detachable detent connection having to be released, structural elements can be positioned relative to one another or repositioning is possible. The snap-in recesses are slot-like, elongated, rectangular, so that a structural element with a connecting element can be slidably locked in the longitudinal direction of the slot. The rectangular design of the snap-in recess with undercuts arranged at two opposing sides and the corresponding snap-in projections at the basic body it is not possible to release or loosen a snap-in connection thus produced by turning, i.e. the snap-in connection is fixed and can only be detached by relatively high force application applied in the exact axial direction. Finally, it is still possible to form snap-in recesses round, so that when a snap-in connection is made, the parts thus connected can be pivoted freely against one another. This embodiment can be provided whenever the relative angular orientation of two components to be connected is not important, or the pivoting capability is specifically desired.

In order to achieve a positioning of the modules when assembling plug-in modules, a module is known from DE 20 2012 001 201 U1, at whose upper part positioning columns are arranged and positioning channels are arranged in the interior thereof, wherein the positioning columns being inserted into the positioning channels during assembly of the building blocks. Specifically, the module is formed as a rectangular housing and has a top wall, four side walls, and an opening at the lower end, wherein a plurality of rectangular blocks protruding from the outer surface of the top wall. An indentation is formed on each of the four side faces of the protruding blocks, wherein a recess being formed between two adjacent indentations positioning column. In the housing, a plurality of projecting ribs are spaced apart on the inner side of each side wall, wherein a positioning channel being formed between each two adjacent projecting ribs of two adjacent side walls and wherein a recess delimited by the positioning channel correspondents with the outer diameter of the positioning column. Accordingly, the distance between the protruding ribs coincides with the width of the indentation so that when a module is merely pulled over the outer sides of one of the protruding blocks of a further module, the building blocks can not rotate relatively and thus are stably positioned. Compared to the conventional building blocks the round tube protruding from the inner surface of the upper wall and/or the same outstanding reinforcing wall hits to the protruding block, the building block according to DE 20 2012 001 201 U1 does not contain either a round pipe or a reinforcement wall, whereby material costs can be saved.

As the foregoing prior art appreciation shows, differently designed plug-in modules with a box-like hollow body open on one side and cylindrical coupling necks/primary pins (push buttons) arranged outside at the bottom side as well as secondary pins (bottom dome) arranged on the inside of the ground are well known. In order to increase the force for holding together the plug-in modules by frictional engagement, partial webs/ribs have been proposed on the inside of the side walls of the hollow body and/or ribs directed towards the inside cross-section circular or polygonal coupling pins (primary pins) which extend vertically and having contact points with the inserted cylindrical or polygonal coupling necks/primary pins arranged at the outer surface of the hollow body.

BRIEF SUMMARY OF THE INVENTION

It is an object of the invention to further develop the toy brick according to DE 1 076 007 B having only a tangential clamping between the toy building block such that an increased frictional connection is achieved.

This object is achieved with a toy brick wherein the plug-in pins arranged on the upper side of the toy brick as well as the bottom dome arranged on the underside of the toy brick are designed as a n-square straight prism with parallel and equal side edges, and in that the rib is designed as a double-stepped holding nose.

The toy brick according to the invention has the advantage that a wide, flat clamping of the individual toy brick relative to one another is achieved during the assembly. This clamping is intensified further by the fact that the plug-in pins are manufactured at the upper side higher than in the case of the toy building blocks according to DE 1 076 007 B, DE 1 837 030 U, DE 2 242 046 A, DE 16 78 326 C3 or DE 60012300 T2. The contact surfaces become even bigger. In particular, the problem in the prior art is avoided in that the only point-to-point connection between the building blocks is lost in connection force, the fewer connections being established. Compared to the round studs of the individual toy bricks, an improvement in the wear resistance is achieved in the toy brick according to the invention, since the round geometry of the studs only has a few bearing surfaces when the blocks are plugged together and thus increased wear occurs.

In a further development of the invention the plug-in pins and the bottom dome are designed as an octagonal straight prism, the corners of which are designed with smooth edges or with rounded edges.

This development of the invention has the advantage that an exact positioning in line or in a 45° angle position is made possible with the same clamping force. The gradations of the corner rounding are fluid, so that all corner shapes of absolutely round to absolutely angular are contained and the force expenditure for the twisting of the toy brick in the plugged state can be specifically adjusted.

BRIEF DESCRIPTION OF THE DRAWING FIGURES

Figure 1B:
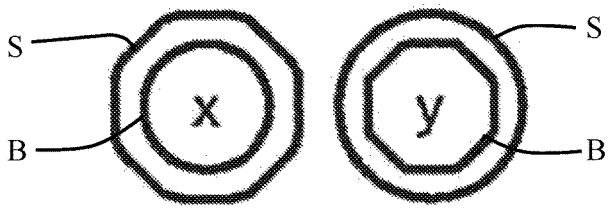
Figure 2A:
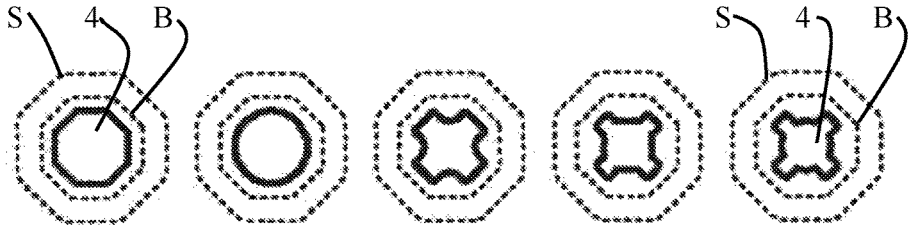
Figure 2B:
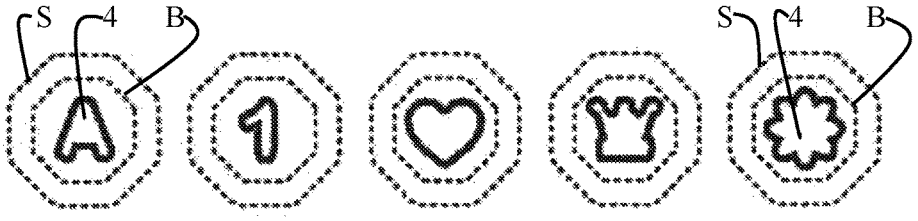
Figure 3A:
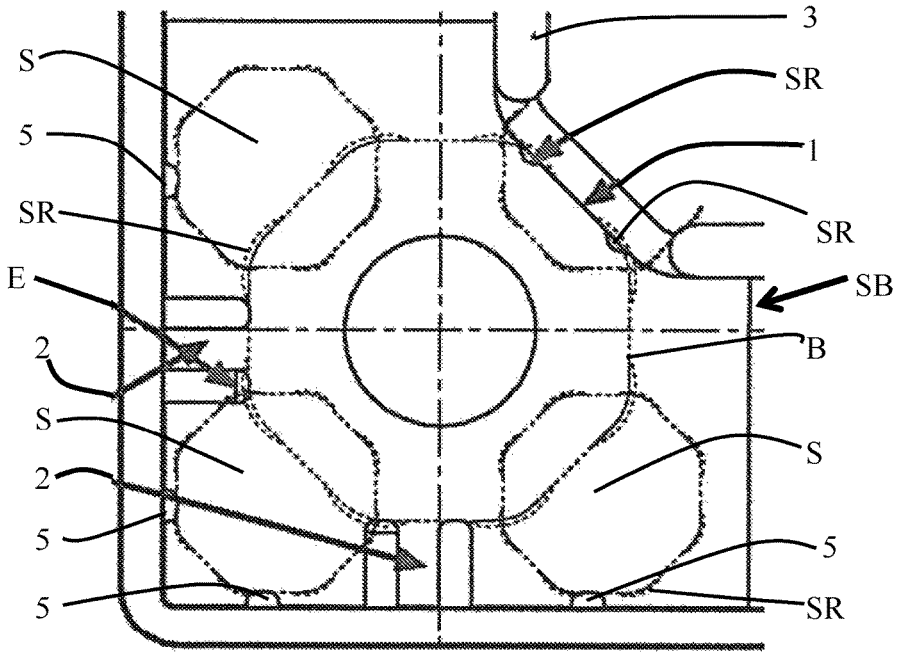
Figure 3B:
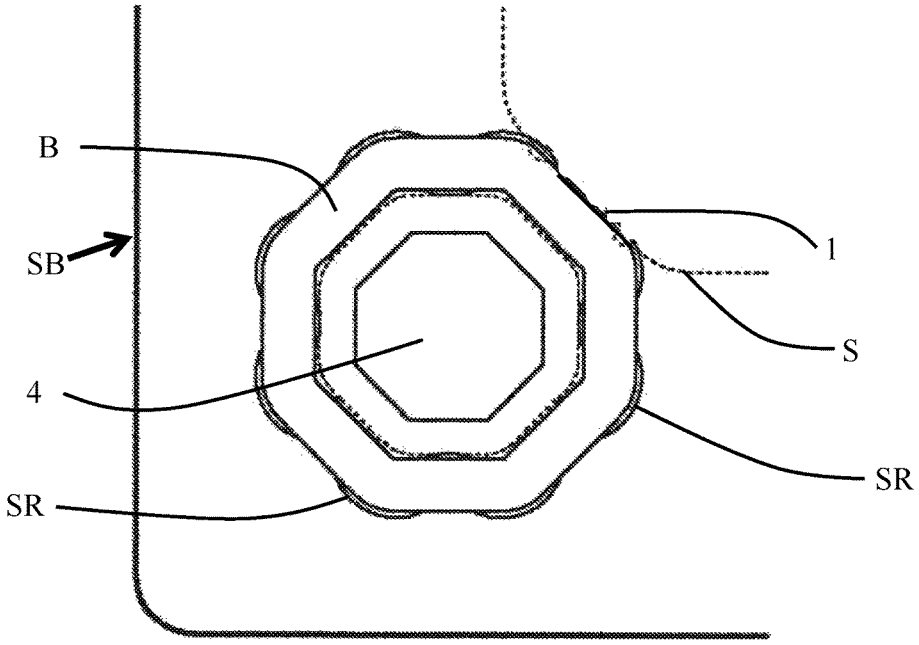
Figure 3C:
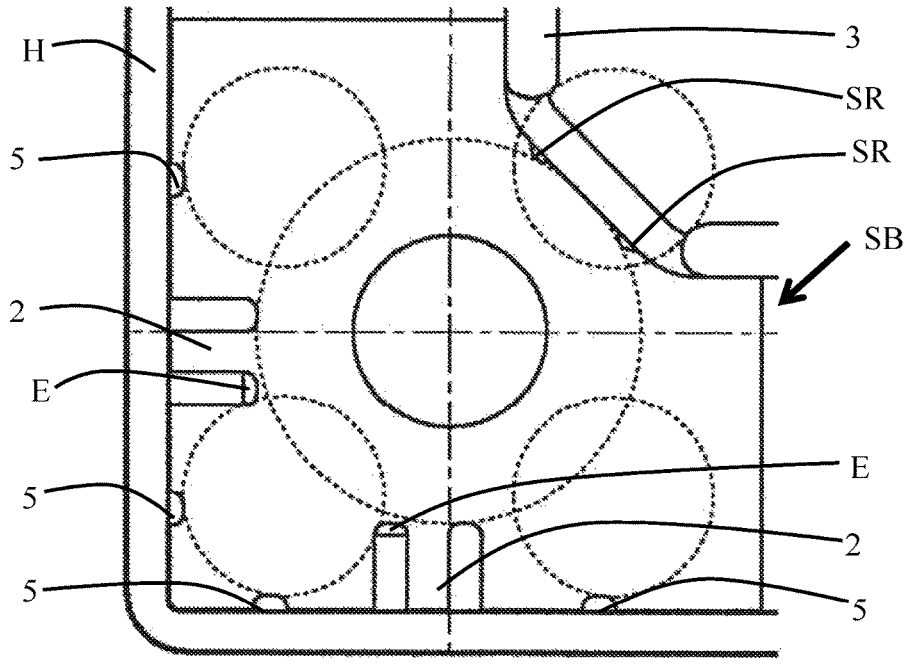
Figure 3D:
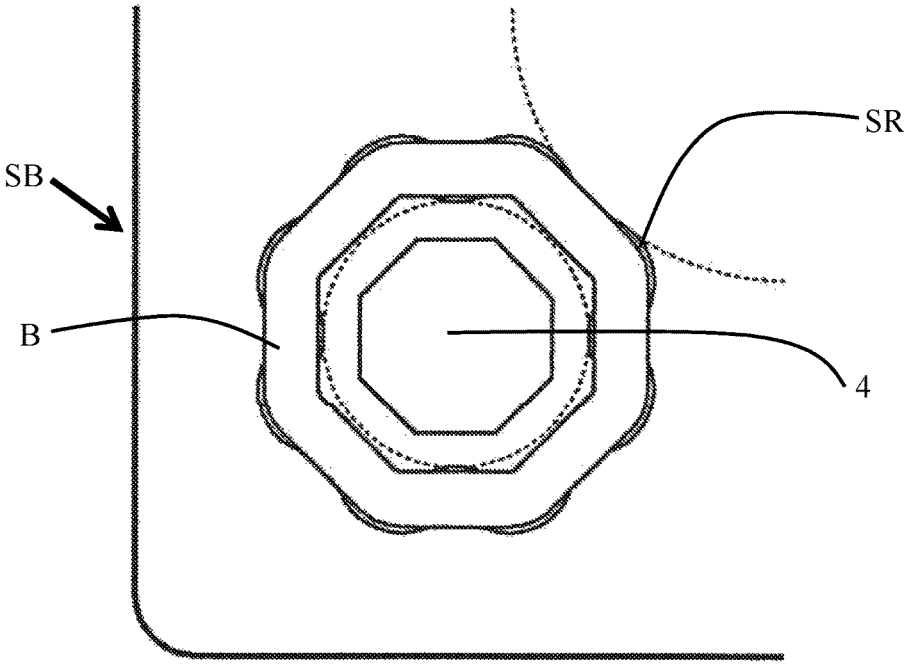
Figure 4A:
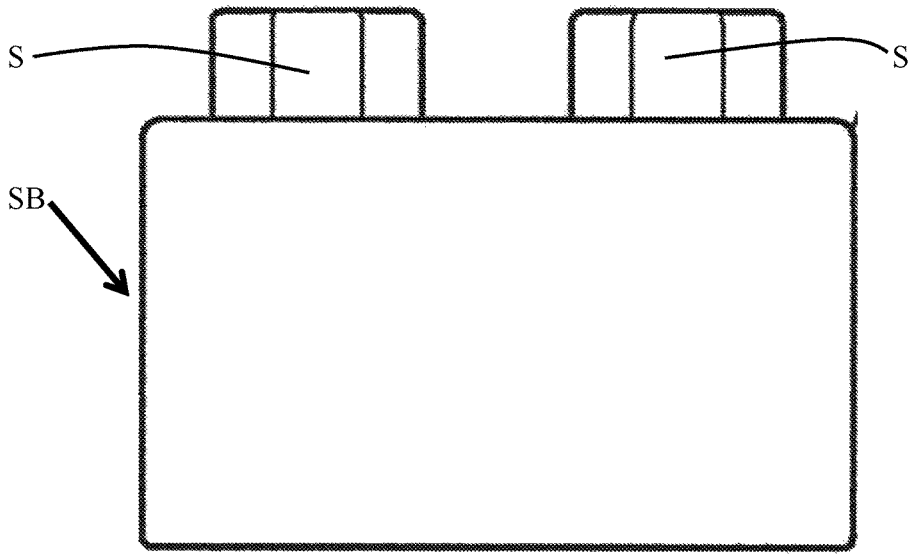
Figure 4B:
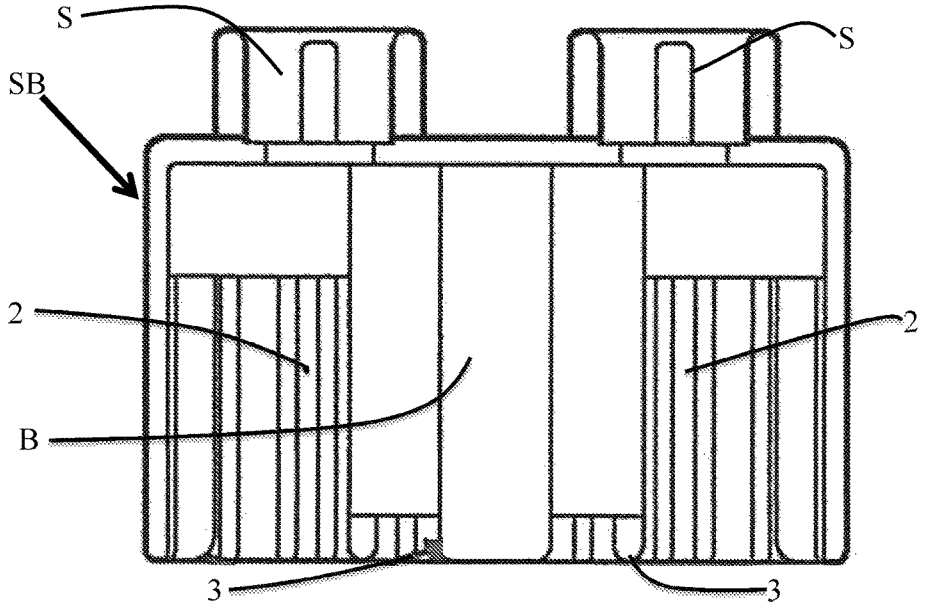
Figure 4C:
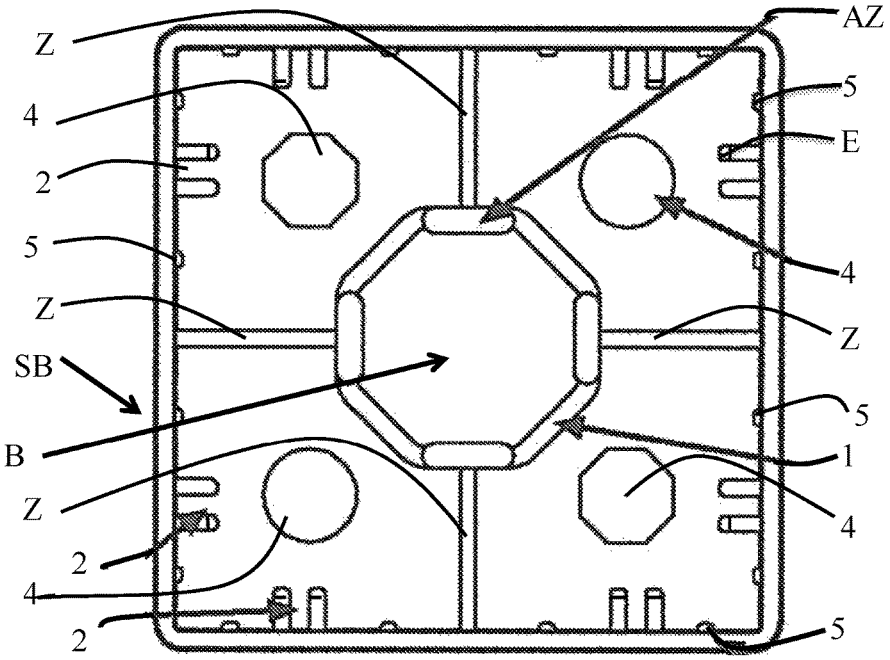
Figure 4D:
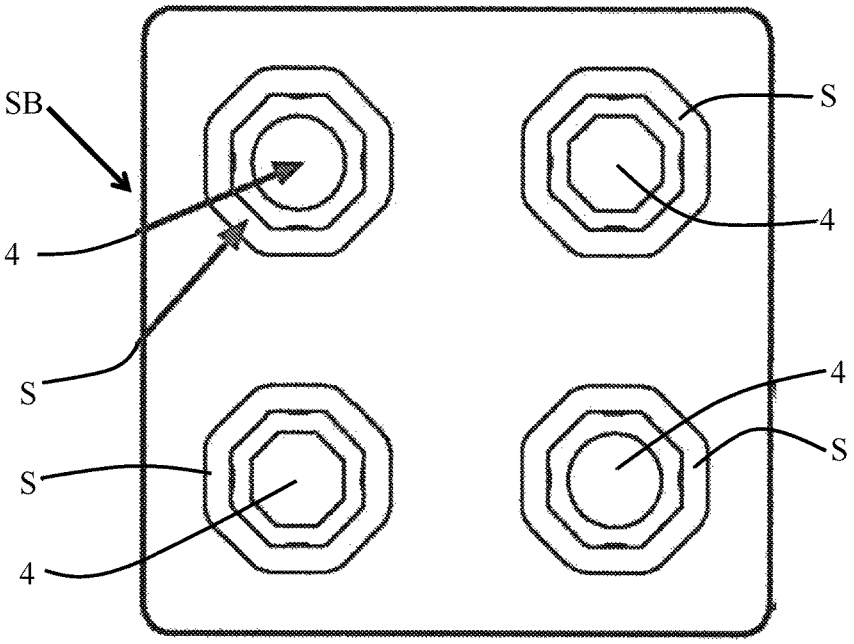
Figure 5A:
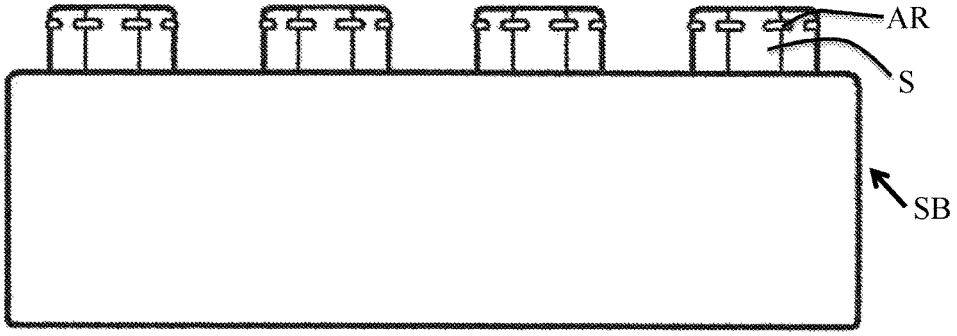
Figure 5B:
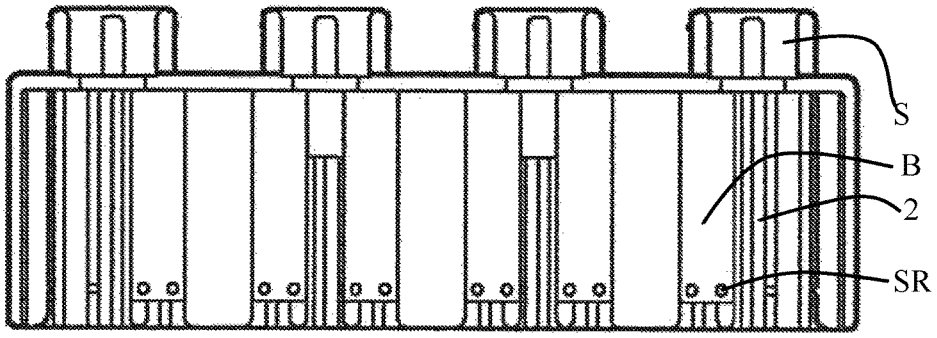
Figure 5C:
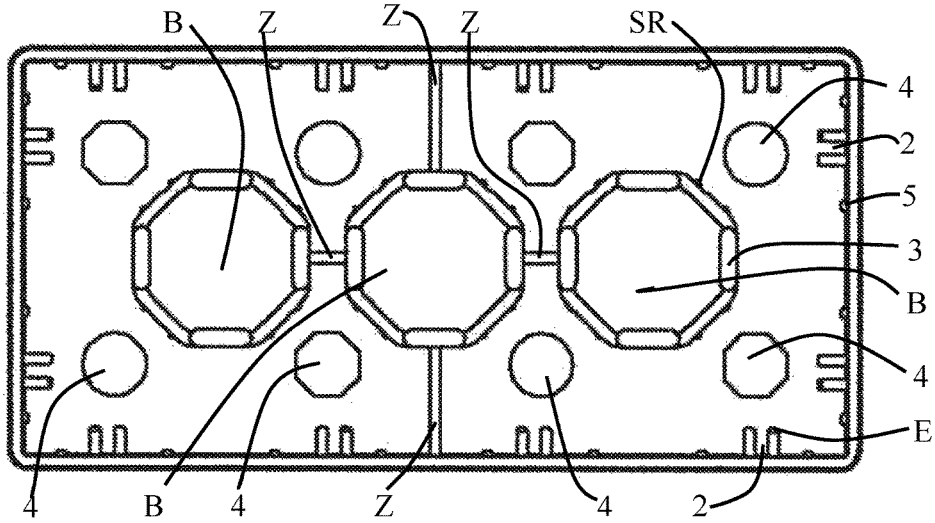
Figure 5D:
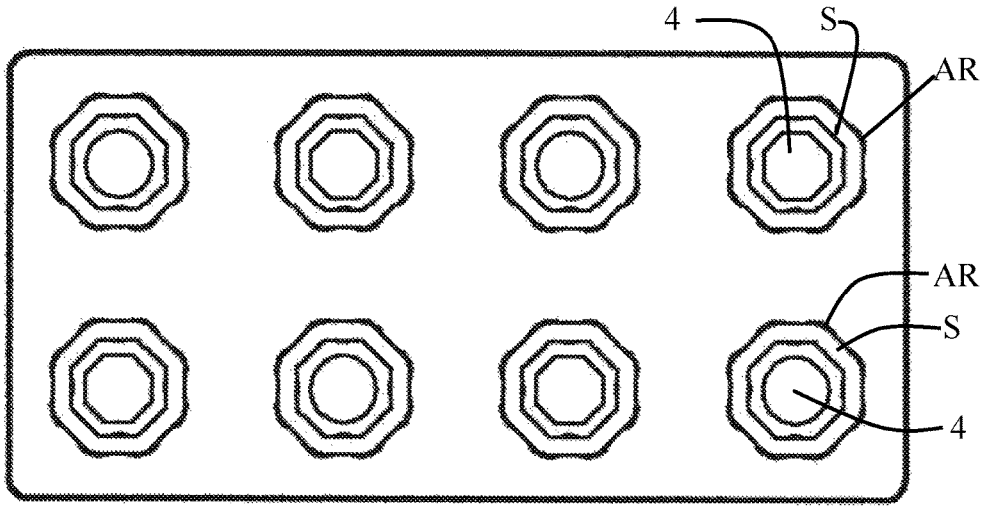

Further advantages and details may be found in the following description of preferred embodiments of the invention with reference to the drawing. In the drawings:

FIG. 1 shows in detail various gradations of the corner rounding of the plug-in pin and the bottom dome, FIG. 2 shows in detail different breakthrough forms on the bottom of the plug-in pin, FIG. 3*a* in detail the bottom view for the clamping and locking of an embodiment of toy bricks according to the invention, FIG. 3*b* in detail the top view of the toy brick according to FIG. 3*a*, FIG. 3*c* in detail the bottom view for the jamming of a toy brick with primary pins and secondary pins of a toy brick according to the invention according to FIG. 3*a*, FIG. 3*d* in detail the top view for the jamming of a toy brick with primary pins and secondary pins of a toy brick according to the invention according to FIG. 3*a*, FIG. 4*a* shows in side view an embodiment of the toy brick according to the invention without snap-in elements, FIG. 4*b* the toy brick according to FIG. 4*a* in a partial sectional view, FIG. 4*c* the bottom view of the toy brick according to FIG. 4*a*, FIG. 4*d* shows the top view of the toy building block according to FIG. 4*a*, FIG. 5*a* a side view of another embodiment of the toy brick according to the invention with jamming and snap-in elements, FIG. 5*b* the toy brick according to FIG. 5*a* in a partial sectional view, FIG. 5*c* the bottom view of the toy brick according to FIG. 5*a*, FIG. 5*d* the top view of the toy brick according to FIG. 5*a* and FIGS. 6*a* to 6*c* in detail an embodiment of snap-in elements locking the toy brick according to the invention.

DETAILED DESCRIPTION OF THE INVENTION

According to the state of the art, also the toy brick SB according to the invention has a box-like hollow body H, open on one side, is discharged with plug-in pins S arranged at the bottom side in each corner region and at least one bottom dome B arranged at the bottom wherein a connection of the toy bricks is by clamping/frictional engagement.

According to the invention, both the plug-in pins S on the upper side of the toy brick SB, also called toy building block SB and the bottom domes B on the underside of the toy building block B, are designed as an n-square straight prism with parallel and equal side edges, whereby a two-dimensional jamming is achieved. Preferably, on the inside of the side wall of the hollow body H there are vertical extended, i.e. seen from the bottom to the opening of the hollow body H, double-stepped holding noses 2. The distance between the parallel to each other extended webs of the holding noses 2 is selected in such a way that each plug-in pin S is contacted several times and, when the consumption of material is reduced, a flexibility of the releasable connection is achieved. Thus, both the toy building blocks SB according to the invention, which are clamped in a two-dimensional manner (see for example FIG. 4*c*, clamping surface 1), as well as pin/knob modules of other manufacturers are compatible and having a good hold. In particular, the holding noses 2 have a rounded longitudinal edge E in order to simplify the insertion of the plug-in pins S to be inserted. In this case, each web or individual web of the holding nose 2 can have a single edge E, preferably a leading bevel with an indentation at the end of the bevel for the snapping/clicking the snap-in element SR of the snap-in pin S at a toy building block SB with click system. As a result, requirements for a secure connection and detachment with relatively high force expenditure can also be met. Furthermore, the user no longer has no longer to accurately position the push buttons S (cylindrical coupling necks/primary pins in the prior art) to the bottom domes B (secondary pins, positioning channels in the prior art) before he use the pressure to reach the final position/combination.

In the embodiments shown in FIG. 3*a* to FIG. 5*d*, the snap-in pins S and the bottom dome B are designed as an octagonal straight prism, the corners of which are formed with smooth edges or with rounded edges (see FIG. 1). For example, FIG. 1 (*a*) shows eight-angled with smooth edges and letter e) octagonal with rounded edges.

If now compatible components from different manufacturers are to be connected, the connecting force between the components and the inventive toy bricks SB can further be reduced. According to the invention, this problem is solved by arranging, on the bottom side, spacing and clamping tines AZ on the bottom dome B which fulfill the following functions:

1. Spacer to opposing toy bricks SB
2. Clamping of compatible toy building blocks
3. Stiffening of the wall of the dome According to the invention, the plug-in pins S have openings, also called breakthroughs, 4 with different shapes. These openings 4 serve to receive plug-in elements, axles, bars, etc. The breakthroughs 4 also contribute to the decorative appearance, by using these as numbers, letters and jewelry molds like flowers, hearts, crowns, figures, animals, etc. (see FIG. 2 or FIG. 4*c* with an octagonal or round opening 4). The openings 4 are angled between 0° and 360° or scaled between 0% and 100%, based on the indentation internal dimension. In addition, a continuous air circulation is achieved by the openings 4, which ensure the oxygen supply in the event of a deliberate or inadvertent transfer of a toy building block SB into a body opening up to the removal of the foreign body. Each toy brick SB has at least one breakthrough 4.

In order to save material during the production of the toy building block SB, these are designed for small wall thicknesses, in particular between 0.5 mm and 1.5 mm, preferably between 0.8 mm and 1.2 min. The necessary stability of the hollow body H is ensured by the incorporation of small, vertical webs 5 (web height between 0.1 mm and 1.0 mm, preferably between 0.3 mm and 0.6 mm, in particular between the holding noses 2 extending parallel thereto stabilizing webs 5 (see, for example, FIG. 4*c* or FIG. 5*c*). As a result, less plastic is used or consumed, the toy pricks SB are thus not given a higher weight and the environment is less burdened in a lesser extent than necessary.

In order to secure the position of the bottom dome B and in order to intercept the plug-in forces even in the case of oblique plugs which are performed with high force expenditure, at least two intermediate walls Z are arranged between the bottom dome B and the side wall of the hollow body H. For example, FIG. 4*c* shows for the centrally arranged bottom dome B four intermediate walls Z and FIG. 5*c* shows for the three bottom dome B the connection of the centrally arranged bottom dome B with four intermediate walls Z on the one hand to the side wall of the hollow body H and on the other hand to the two adjacent bottom dome B. Furthermore, the bottom dome B can be designed with a small wall thickness so that, on the one hand, the elasticity of the clamping connection is increased and on the other hand higher dimensional tolerances are possible.

Like the embodiments of the toy brick SB according to FIG. 3*a* to FIG. 5*d* shows, all the edges of the toy building block SB are flattened by hand. This takes into account the increased safety requirements of the target group and the risk of pressure points or injuries is therefore kept low.

In the case of the compatible building blocks of various manufacturers, it can only be ensured by means of visual inspection or printing that they have taken their final desired position. According to the invention, a click system is provided which ensures for the user, in addition to visual and haptic, an acoustic perception of the execution of the clamping of two game blocks SB. In particular, the plug-in pins S have snap-in elements SR arranged in the region of the outer ends on the side wall, which during the snap-in procedure are inserted in the holding nose 2 or on the side wall of the spacing and clamping tines AZ arranged snap-in receptacles AR in the form of snap-in projections or depressions or recesses arranged in the side wall. When the releasable connection is closed, the toy building blocks SB are audibly interlocked, in that, when two or more toy building blocks SB are joined, the force required being applied increases shortly before the end position is reached and then abruptly drops again. As a result, the two surfaces, namely the bottom surface/edge of the toy building block SB and the cover surface of the already installed toy building block SB, abut one another and produce a so-called click sound.

Preferably, the snap-in elements SR are designed as snap-in projections in the form of noses, webs, rings, points or snap-in receptacles in the form of depressions or recesses AR. These are designed in such a way that they during the plug-in operation, snap-in, snap-fit and/or click in complementary and/or overlapping like shapes arranged on the underside of the building blocks SB of the bottom dome B and/or of the asymmetrical holding noses 2. Within the scope of the invention, the snap-in projections SR or snap-in receptacles AR (indentations or recesses) have run-up bevels or undercuts. In particular, as a result, in addition to the clamping connection (force-fit/frictional connection), the additional form connection enables a secure both form-locking and frictional connection and the release of this connection with a defined force expenditure.

Figure 6A:
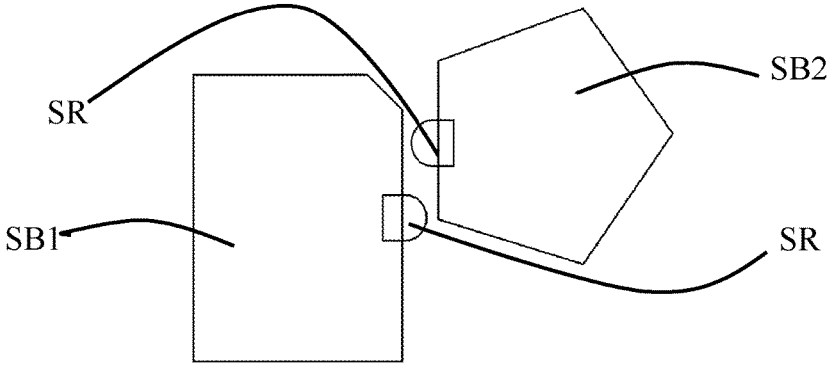
Figure 6B:
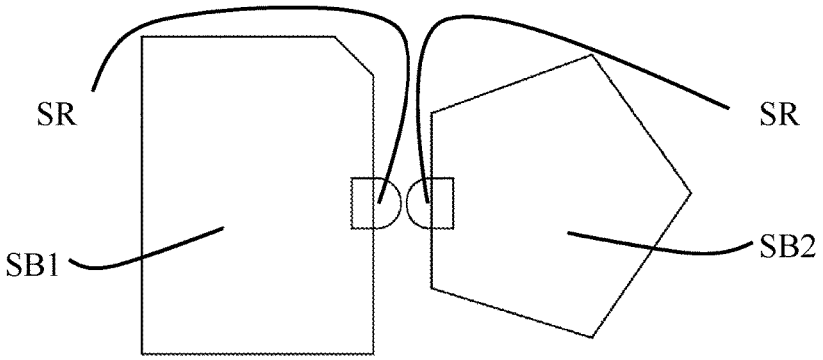
Figure 6C:
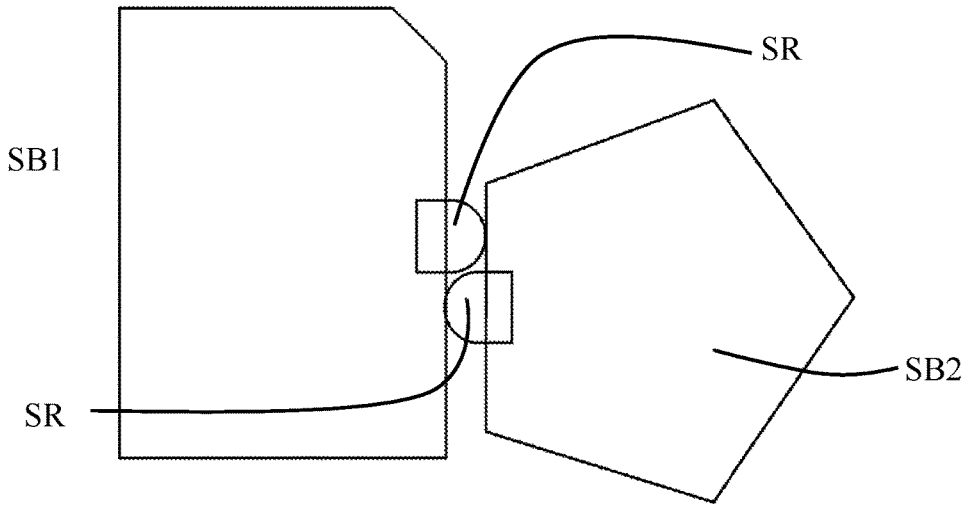

In FIG. 6*a* to FIG. 6*c*, an embodiment of the click system is shown. The advantage of such a clamping or latching connection against a conventional plug-in connection (rake, point or line clamping) is the relaxed end position of the toy building blocks SB after the assembly. This is also characterized in particular by the fact that no significant loss in the strength of the clamping connection occurs even after a long connection, frequent dismantling and reassembly with other (compatible) toy building blocks. A reduction in pull-off forces due to the nature of the surfaces and the surface coating (e.g. fat, hand welding) is also not visible. The geometry of the toy building blocks SB to be connected can be used in any form of the hollow body H (round, rectangular, triangular, etc.).

As shown in FIG. 6*a*, the required force expenditure increases up to the highest point of the knobs/pins (nose, ring, point) SR when the blocks SB1 and SB2 are pressed together. The highest point of the knobs SR corresponds to the highest force expenditure, as FIG. 6*b* shows. After overcoming the highest pin point the block SB1 the force to be applied decreases rapidly strikes the cover surface of the module SB2 (over the snap-in position up to the mechanical stop) with its bottom surface. This creates an audible click sound.

In order to further increase the elasticity of the connecting region, the snap-in elements SR, in particular the plug-in pins S, or the snap-in receptacles AR, in particular the crenellations 3 of the bottom dome B, have a dilute wall thickness.

In summary, with the toy brick SB it is achieved, through an environmentally friendly production with environmentally friendly materials, a toy building block can be connected by a flat connection to another, which can be designed with a small wall thickness. The cohesion of the toy pricks SB is improved by double noses, multiangular snap-in SR and multiangular bottom dome B. The player's success is audibly documented. The existing hazards for the target group are minimized.

The invention is not limited to those shown and described examples but also includes different embodiments that are similar to the present caused substantial effect described in the invention. Within the scope of the invention, in addition to the snap-in elements SR or, alternatively, the lateral surfaces of the plug-in pins S and correspondingly the lateral surfaces of the bottom domes B can be smooth with a slightly profiled or rough surface (friction surface) and then again with a smooth surface, so that an increased plug-in force is required only in this (intermediate) region and before reaching the end position. Conversely, this also applies to the pull-off forces. With regard to the connection of the toy bricks SB at an angle to one another, for example in multiples of a 45° angle for an octagonal straight prism or multiples of a 60° angle for a six-cornered straight prism or multiples of a 90° angle in the case of a quadrangular straight prism, while retaining the improved cohesion and clicking noise, pin slopes or undercuts may be formed in the context of the invention in the form of snap-in receptacles AR (depression or recesses) extending at an angle to the horizontal. Correspondingly, the snap-in elements SR, in particular snap-in projections in the form of pins, webs, rings, points or depressions or recesses AR could be formed sectionwise and/or at an angle to the horizontal. In the context of the invention, the n-angular pin and dome shape S, B can also be designed either as an external shape or only as an internal shape (see FIG. 1, No. x and No. y), or else as an external and internal shape.

Furthermore, the toy bricks SB based on a biodegradable biopolymer (instead of the plastic acrylonitrile-butadiene-styrene copolymer (ABS)), in particular a high-quality, thermoplastic material based on the natural polymer lignin, biopolymers, polyhydroxyalkanoates, -butyrates, polycaprolactone, polyester, starch, Ingeo™, natural resins, -waxes, -oils, natural fatty acids, cellulose, biological additives, and natural reinforcing fibers could be produced. The bonding strength and/or stability between the components put together can be adjusted in a defined manner according to the invention by the geometrical design as well by the structural integrity, surface quality, —roughness and the material composition of the connecting elements of the toy bricks, in order to prevent, in turn, an excessively high connection stability and stiffness even with regard to the breathing openings 4 in the plug-in pins S, and to reach to known toy building blocks SB made of impact-resistant plastics, for example the plastic ABS, comparable mechanical stability, comparable optics or haptics, such as injection molding tests and mechanical properties testing, heat distortion resistance, mold shrinkage, workability, weathering resistance and biodegradability verifies.

Furthermore, the invention has not yet been limited to the feature combination defined in claim 1, but can also be defined by any other combination of certain features of all the disclosed individual features. This means that in principle every single feature of patent claim 1 can be omitted or replaced by at least one individual feature disclosed elsewhere in the application the individual feature is disclosed.

The invention claimed is:

1. A toy brick comprising:

a rectangular box-shaped hollow body having an open bottom side, at least four plug-in pins arranged on an upper side of the rectangular box-shaped hollow body, wherein each one of the at least four plug-in pins extends from the upper side of the rectangular box-shaped hollow body in a respective corner region, a tube centrally arranged on an inside of the hollow body extending toward the bottom side, and at least one double-stepped holding nose arranged on each side wall of the hollow body projecting toward the inside, wherein each double-stepped holding nose comprises a pair of spaced apart ribs that extend parallel to each other toward the upper side as viewed from the open bottom side of the rectangular box, wherein both the plug-in pins arranged on the upper side of the toy brick and the tube are configured as straight prisms with parallel and equal sides and smooth edges or rounded edges, wherein the straight prisms are either octagonal straight prisms or hexagonal straight prisms, and wherein the toy brick is configured to be connectable to another toy brick by inserting at least one of the plug-in pins arranged on the upper side of the rectangular box-shaped hollow body inside the another toy brick between the tube and at least one of the ribs, said at least one of the ribs including a rounded edge for simplifying insertion of the at least one plug-in pin of the another toy brick.

2. The toy brick according to claim 1, wherein spacing and clamping tines are arranged on the tube, which:

space connected toy bricks;

clamp compatible toy building blocks; and stiffen a wall of the tube.

3. The toy brick according to claim 1, wherein each of the plug-in pins is provided with a cavity that extends toward the bottom side, and wherein the cavities define at least two different shapes.

4. The toy brick according to claim 1, further comprising stabilizing webs arranged between and extending parallel to each of the holding noses.

5. The toy brick according to claim 1, further comprising at least two intermediate walls arranged between the tube and the side walls of the hollow body.

6. The toy brick according to claim 2, wherein the plug-in pins have snap-in elements arranged at an outer end region, wherein the snap-in elements are configured to engage with the holding nose or the spacing and clamping tines such that an audible click occurs when two toy bricks are detachably connected to each other.

7. The toy brick according to claim 6, wherein the snap-in elements are configured as detents, and are in a form of lugs, webs, rings, points, depressions or recesses.

8. The toy brick according to claim 6, wherein the snap-in elements have run-up bevels or undercuts.

9. The toy brick according to claim 6, wherein the snap-in elements have a narrower wall thickness than a surrounding area of the plug-in pins to increase elasticity of a connecting region defined by the snap-in elements.

* * * * *